United States Patent [19]

Roel-Rodriguez

[11] Patent Number: 4,907,796

[45] Date of Patent: Mar. 13, 1990

[54] SKI SIMULATOR

[76] Inventor: Santiago Roel-Rodriguez, Río Lerma 111, Desp. 2, Col. Miravalle, Monterrey, Nuevo León, Mexico

[21] Appl. No.: 171,957

[22] Filed: Mar. 23, 1988

Related U.S. Application Data

[63] Continuation-in-part of Ser. No. 65,414, Jun. 22, 1987, abandoned.

[51] Int. Cl.[4] ..... A63B 69/18

[52] U.S. Cl. ..... 272/97; 272/132

[58] Field of Search ..... 272/97, 132, 133, 146, 272/70, 69, 94, 96; 434/253; 128/25 R, 25 B

[56] References Cited

U.S. PATENT DOCUMENTS

| | | | |
|---|---|---|---|
| 3,582,066 | 6/1971 | Keryluk | 272/97 |
| 3,650,528 | 3/1972 | Natterer | 272/132 |
| 4,483,532 | 11/1984 | Sparks | 272/132 |
| 4,544,153 | 10/1985 | Babcock | 272/97 |
| 4,560,165 | 12/1985 | Witteman et al. | 272/146 |
| 4,645,201 | 2/1987 | Evans | 272/70 |

OTHER PUBLICATIONS

Cross Country Shortcut–Edward Pauls, Washington Star/Mar. 30, 1980 p. 23.

*Primary Examiner*—Stephen R. Crow

*Attorney, Agent, or Firm*—Abelman, Frayne, Rezac & Schwab

[57] ABSTRACT

An alpine ski simulator for reproducing the basic corporal movements involved in downhill skiing, comprising a frame which may be set at different angles relative to the horizontal plane, and a handrail for equilibrium purposes. A rotatable platform, horizontally mounted on the frame through a central shaft has roller means set between the platform and the frame to ease the rotation. A fixed band encircling the platform, guided between two pairs of posts, and connected to the frame, is provided for braking purposes. Adjustable means are attached between the band and the frame to increase or reduce the tension of the band against the platform and thus, vary the rotational speed of the platform.

1 Claim, 3 Drawing Sheets

SKI SIMULATOR

RELATED APPLICATION

This application is a continuation in part of S.N. 065,414 filed June 22, 1987, now abandoned.

FIELD OF THE INVENTION

This invention relates to the sport of downhill or alpine skiing and specifically, to a ski simultor. This simulator enables the user to reproduce the basic corporal movements involved in skiing.

BACKGROUND OF THE INVENTION.

Snow skiing is a recreational and competitive sport. It is enjoyed worldwide by many enthusiasts regardless of age, sex and ability.

This sport requires the use of a pair of skis, ski boots, a binding system, ski poles and thermal clothing.

The skier takes advantage of a snow-covered slope to slide down on snow skis. Speed and direction are controlled by the skier's corporal movements.

The skier must turn constantly from side to side. This alternate change of direction will place the skis across the fall line and reduce sliding speed.

However, snow skiing requires the knowledge of a technique. The assistance of certified instructors and constant practice will enable the skier to the development of special skills.

Said technique basically consists of the application of different levels of pressure on the skis to control direction and acceleration. This pressure is exerted with the feet and legs of the skier.

The long flat runners, called skis, are flexible and have a slight downward camber. When pressure and weight are applied on the inside edge, the ski flexes into a reverse camber. This arched ski carves a turn on the snow according to its new shape.

To make a turn, the skier must fully weight his outside ski (as regards to the turn) and simultaneously unweight his inside ski. This will make the outside ski carve a turn. The skier balances his full weight on his outside ski and allows his inside ski to follow. Once the turn is completed, the skier may reverse the process and turn in the opposite direction. The radius and speed of the turn will depend on the slope, snow conditions and the pressure exerted on the ski.

It is of vital importance that the skier maintains a stable upright position. This means that his legs will turn in either direction while his torso remains facing the fall line, in anticipation of the next turn. The torsion of the legs in relation to the upper part of the body occurs at the waist in a relaxed and natural manner.

As implied by the above, the acquisition and mastery of the technique require much practice and effort. Only those persons with the proper means, resources and leisure time, may reach a high level of ability.

Likewise, the sport is usually practiced at ski resorts and during certain months of the year, thus reducing the skier's opportunity to improve his technique.

In this field, there have been previous developments of ski-simulators, striving to help the skier reproduce the corporal movements required by this sport. Some of these simulators are illustrated in the U.S. Pat. Nos. 3,650,528; 3,707,283 and 3,807,727. It must be noted that these simulators fail to reproduce the dynamics of the snow ski on a slope. Therefore, said simulators force the user into corporal movements which are not only different, but contrary to those required in skiing.

Likewise, some of these simulators are misdirected on the skidding, or lateral slide of the ski, while turning. This skidding is caused by the centrifugal force of the turn in combination with a loss of grip by the edge of the ski, as occurs when a car turns too rapidly over a slippery road. In any case, skidding is caused by the turn. Therefore, the user becomes confused in his effort to improve his turns, since he will concentrate on twisting his legs to create skidding, instead of focusing on the correct weight shift from leg to leg.

Other simulators do not include braking devices in their rotatory mechanism. This fails to reproduce the natural inertia of the ski, over-accelerates the user in his rotation and may jeopardize safety. The user is thus prevented from learning and practicing the corporal movements required to control acceleration and direction of the skis.

Many defects in the prior art are caused by erroneous interpretations of appearances. The basic line of skiing is that the skis, and not the skier, do the turning. Skis turn due to their dynamics. They are a tool to be maneuvered by the skier through the application of pressure. The twisting at the waist must be the effect and not the cause of the turn.

With these defects clear in the prior art, the present invention is referred to as a ski simulator which artificially reproduces the dynamics of the skis, through the use of essential elements of this sport such as, gravity, weight friction and a sloped surface. The user is guided to make turns by shifting his weight from leg to leg and to control the speed of the turns with the variation of pressure by flexing the knees, as would in true reality.

Basically, the simulator of the present invention comprises a frame, which may be set at different angles relative to the horizontal plane, said frame includes a mechanism to regulate the inclination as desired by the user and a handrail for equilibrium purposes. A central shaft connected in a perpendicular fixed position to said frame. A platform horizontally mounted on said frame through said shaft. A ring-shaped member attached under said platform. Roller means positioned between said frame and the platform to ease rotation. And, a braking device coupled from the periphery of the ring-shaped member to said frame, to adjust the rotation speed of said platform.

As may be inferred by the above, the ski simulator of the present invention, artificially reproduces the basic dynamics of a ski on a snowed slope. Attention focuses on the creation of turns by the exertion of pressure on either leg, instead of forcing the user into unnatural and awkward body movements.

The simulator will improve the user's technique. The user may perfect his weight shifts and the skill of balancing throughout the entire turn exclusively on the outside foot. Variable options of slope and breakage are available. The simulator may improve the user's skills in balance, anticipation, rhythm, stance and reflexes and will also exercise the muscles involved in skiing. This may contribute to increased muscle tone and cardiopulmonary capacity, thus becoming an essential aid to any skier who wishes to develop his skills in a practical, comfortable and economical manner.

OBJECTS OF THE INVENTION.

The first object of the present invention is to provide a ski simulator which artificially reproduces the dynamics of the snow ski on a slowed slope, to help the user simulate the proper basic body movements inherent to alpine skiing. Additionally, it will help him improve his skiing technique, balance, reflexes, anticipation, rhythm, coordination, muscle tone and fitness in a practical manner.

A second object of the present invention is to provide a ski simultor that makes the user focus on his weight shifting from one leg to the other and to balance exclusively on the outside foot throughout the entire turn.

A third object of the present invention is to provide a ski simulator that centers the user's attention on the proper movements of skiing, which are directed to the manipulation of the ski by pressure exertion. He is deterred from making unnatural and awkward body twists which are contrary to skiing.

A fourth object of the present invention is to provide a ski simulator that contributes to the stimulation of muscle tone and cardio-pulmonary activity for the user, disregarding the fact that he may, or may not, be a skier, since said simulator is easy to maneuver.

These and other objects and advantages of the ski simulator, as described, will become clear to experts in the field upon examination of the following detailed description of the invention. Such description illustrates, but does not limit, the scope of the present invention.

DETAILED DESCRIPTION OF THE INVENTION.

Figure 1:
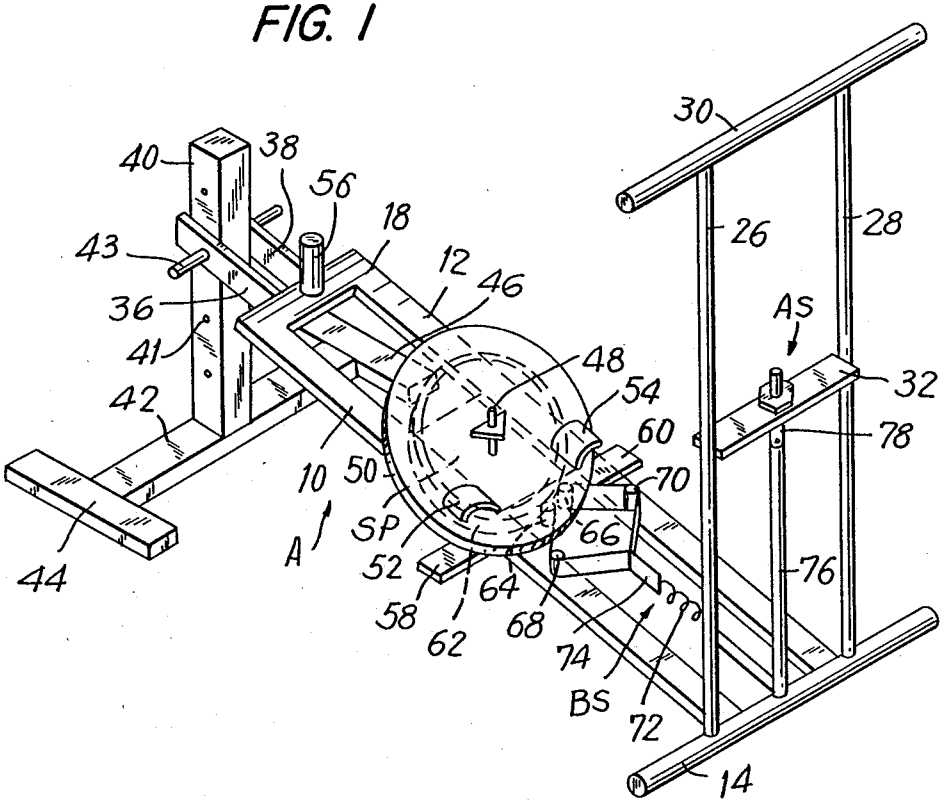
FIG. 1, shows a conventional perspective of the ski simulator of the present invention.
Figure 2:
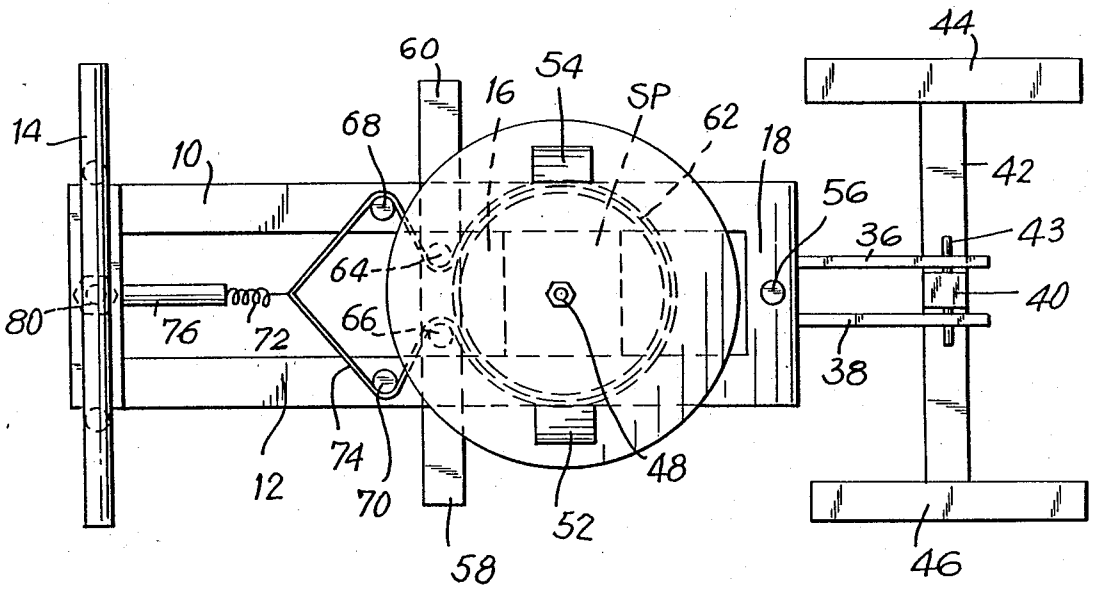
FIG. 2, shows a top view of the ski simulator illustrated in FIG. 1; and, FIG. 3, shows a lateral view of the ski simulator illustrated in FIGS. 1 and 2.
Figure 3:
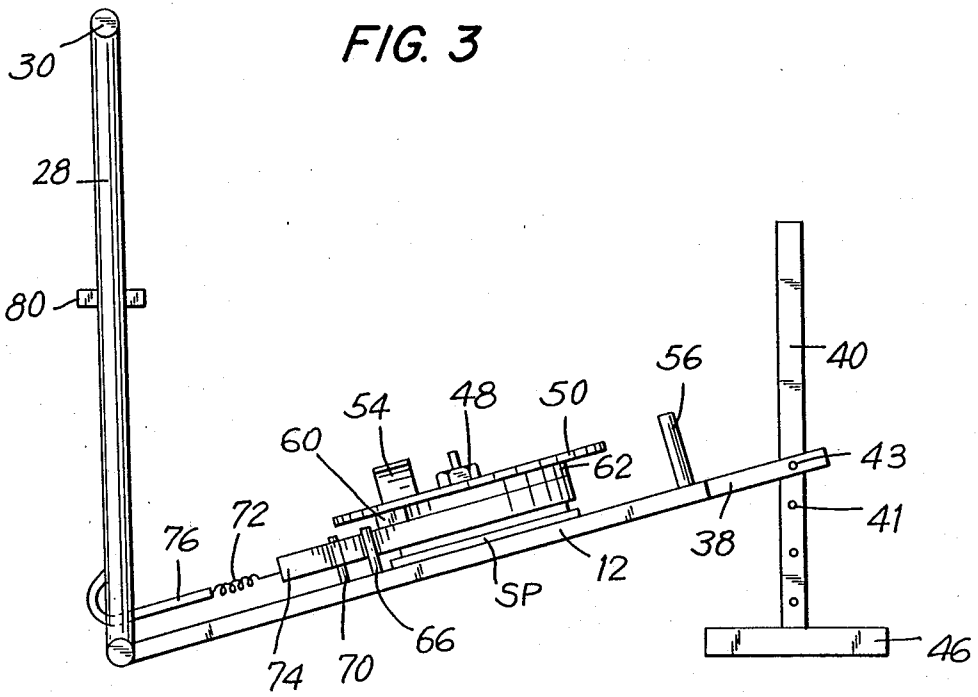

FIGS. 1 to 3 show a rectangular frame formed by two parallel tubes or members 10 and 12, respectively joined at cross members 14, 16 and 18. Cross member 14, at the front end of frame A, is larger than the others and functions as stabilizer. A support plate SP is attached between cross members 16 and 18.

Leg members 26 and 28 are coupled to the front end of members 10 and 12. A handrail 30 is attached to the upper end of leg members 26 and 28 and may be used for equilibrium while executing diverse ski movements. A cross member 32 is attached between leg member 26 and 28, wherein adjusting section of braking system BS is coupled, as will described later.

At rear end of frame A, connectors 36 and 38 are attached to the middle portion of cross member 18 in a perpendicular position. A vertical support member 40 having transversal holes 41. Then the connectors 36 and 38 may be coupled to said vertical support member 40, at different settings, by a bolt 43. Cross member 42 is attached to the lower end of vertical support member 40. End members 44 and 46 are attached to both ends of cross member 42 and serve as a basis to secure stability of frame A.

Central shaft 48 is perpendicularly connected to support plate SP. Platform 50 is mounted for rotation on support plate SP by said central shaft 48. Conventional roller means (not shown) are positioned between platform 50 and support plate SP to facilitate rotation.

Foot settings 52 and 54 are positioned on platform 50 and serve to secure feet of user as shown in FIGS. 1 to 3.

A bumper 56 is positioned on cross member 18 and checks rotation to either side of platform 50, through stop members 58 and 60 attached under said platform 50.

Braking system BS is provided to regulate rotation speed of platform 50, and as shown in FIG. 2, include: a ring-shaped member 62 attached under platform 50; vertical posts 64 and 66 positioned on cross-member 16; vertical posts 68 and 70 positioned on members 10 and 12; spring 72 and adjusting system AS positioned at cross member 32. A band 74 which encircles the ring-shaped member 62, each end of the band 74 is led past the internal side wall of posts 64 and 66 and past the external side wall of posts 68 and 70; both ends of band 74 are secured to rear end of spring 72; a band 76 is secured to front end of spring 72 and led past underside of cross-member 14 to adjusting system AS at cross member 32.

Adjusting system AS comprises bolt 78 secured to other end of band 76 and passed through cross member 32 and wing-nut 80, which may be used to calibrate tension of spring 72. This arrangement secures contact of band 74 against side wall of ring-shaped member 62.

To operate, the user stands on platform 50, inserts feet in settings 52 and 54 respectively, faces front end of frame A and holds handrail 30 with both hands.

The user may proceed to exert his total weight on one leg; if the weight is on the right leg, platform 50 will rotate to the left; if the weight is placed on the left leg, the process is reversed. He will balance exclusively on one foot until the rotation is completed and then proceed to shift his weight to the other foot. This procedure, in continued alternating form, will result in linked turn practice.

The flex of the user's knees will absorb the finishing process of each turn.

Swiveling will occur from the waist down while the upper part of the body remains steady with the aid of handrail 30, which the user holds constantly with both hands to maintain balance.

Special note should be taken of the following distinguishing feature: The ski simulator has a built-in braking system BS which the user may fix at different tension settings of his choice, to increase or reduce the rotation speed of platform 50. This braking system protects the user from excessive acceleration during each turn. This relative resistance to rotation, created by the friction of band 74 pressing against the side wall of ring-shaped member 62, simulates the inertia of the snow ski while in actual use and thus, is an essential component of the simulator.

Bumper 56 on frame A and stop members 58 and 60 under platform 50, serve as a safety device to prevent excessive rotation.

Frame A may be inclined at different angles relative to the horizontal plane, according to the user's choice. These angles correspond to the actual inclination of most slopes he may meet Finally it must be clear that the invention does not limit itself exclusively to the above presented description, and that experts in the field can, with the teaching provided by this invention, make modifications to the ski simulator. Therefore, the present invention must no be considered to be restrictive, except with respect to that which is required by the previous art and by the scope of the attached claims.

While the above description contains may specificities, the reader should not construe these as limitations on the scope of the invention, but merely as exemplifications of a preferred embodiment thereof. Those skilled in the art will envision many other possible variations within its scope. Accordingly, the reader is requested to determine the scope of the invention by the following:

I claim:

1. An alpine ski simulator comprising:

a frame including adjustment means to adjust the inclination of the frame relative to a horizontal plane;

a central shaft connected in a perpendicular, fixed relationship to the frame;

a generally circular platform horizontally mounted on the frame, through the shaft, for rotation and including a ring shaped member mounted underneath said platform;

roller means positioned between said platform and said frame to facilitate rotation;

a fixed band encircling the ring shaped member and attached to the frame for braking purposes, to regulate the rotational speed of said platform;

an inner pair and outer pair of guiding posts vertically attached on the frame, near of the perimeter of the platform, said inner pair of said posts the band against the ring shaped member of the platform the outer pair of said posts provide tensioning to said band; and, adjustable spring means connected between the band and the frame, to adjust the tension of the band against the ring shaped member, and thus, increase or reduce the speed of rotation.

* * * * *